United States Patent [19]

Dorr et al.

[11] 4,066,114

[45] Jan. 3, 1978

[54] SUPERVISION AND CONTROL OF CONTINUOUS CASTING

[75] Inventors: Wolfgang Dorr, Essen; Hartwig Matzner, Duisburg, both of Germany

[73] Assignee: Mannesmann Aktiengesellschaft, Dusseldorf, Germany

[21] Appl. No.: 604,796

[22] Filed: Aug. 14, 1975

[30] Foreign Application Priority Data

Aug. 20, 1974 Germany ..... 2440273

[51] Int. Cl.[2] ..... B22D 11/12

[52] U.S. Cl. ..... 164/4; 164/154; 164/155; 73/295

[58] Field of Search ..... 164/4, 154, 155, 156; 73/295

[56] References Cited

U.S. PATENT DOCUMENTS

| | | | |
|---|---|---|---|
| 3,358,743 | 12/1967 | Adams | 164/154 |
| 3,759,309 | 9/1973 | Nighman | 164/4 |
| 3,886,991 | 6/1975 | Meier et al. | 164/4 |
| 3,921,697 | 11/1975 | Petry | 164/4 |
| 3,923,091 | 12/1975 | Dorr et al. | 164/4 |

*Primary Examiner*—Leonidas Vlachos
*Attorney, Agent, or Firm*—Ralf H. Siegemund

[57] ABSTRACT

The continuous casting of steel is supervised and controlled by measuring total heat flow and the ratio of upper to lower heat flow into the mold and causing these two valves directly or indirectly to be represented in a two dimensional field. The resulting operating point must remain within an empirically predetermined range for safe operation without skin rupture.

11 Claims, 1 Drawing Figure

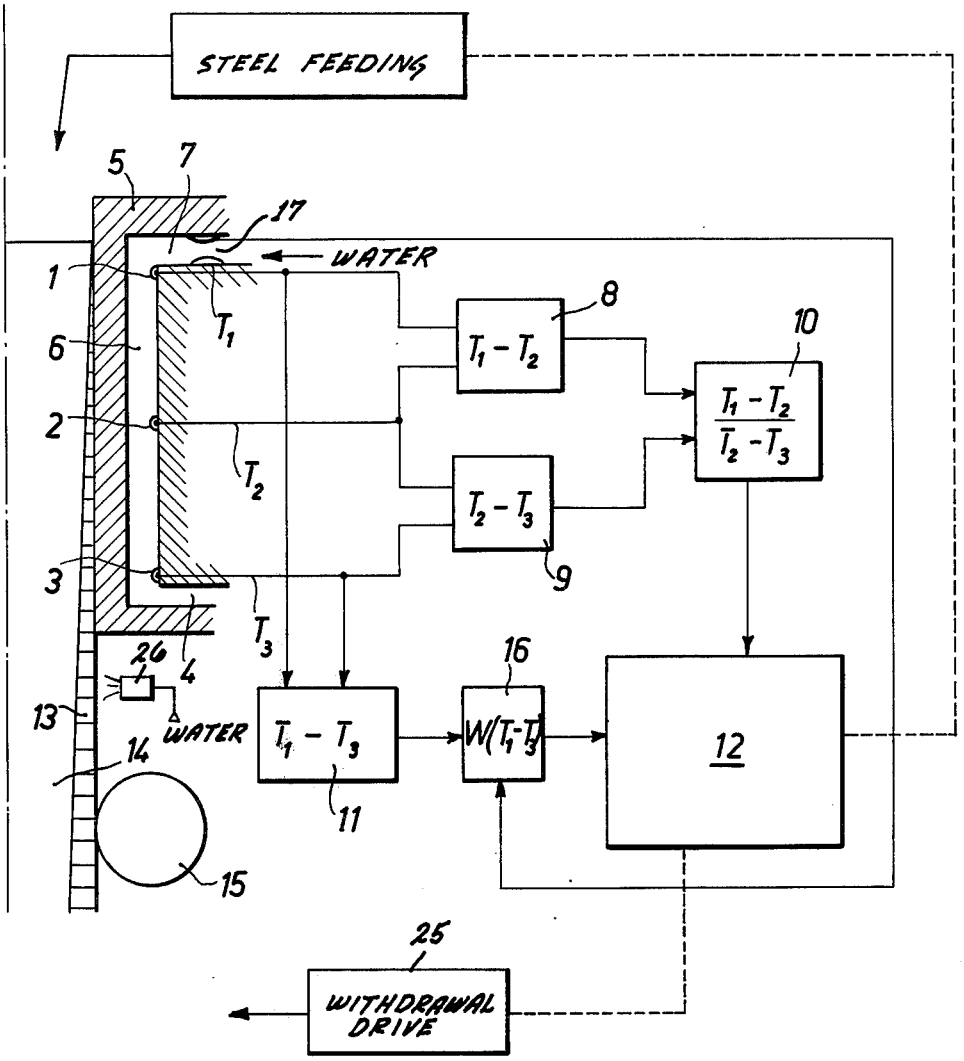
STEEL FEEDING
5
7
17
WATER
1
6
2
3
$T_1$
$T_2$
$T_3$
8
$T_1 - T_2$
10
$\frac{T_1 - T_2}{T_2 - T_3}$
$T_2 - T_3$
9
26
4
13
WATER
14
$T_1 - T_3$
11
16
$W(T_1-T_3)$
12
15
25
WITHDRAWAL DRIVE

SUPERVISION AND CONTROL OF CONTINUOUS CASTING

BACKGROUND OF THE INVENTION

The present invention relates to a method and equipment for the supervision and control of the continuous casting of steel.

It is highly desirable to run the continuous casting process of steel at a high speed of casting. Such high speed operation is obviously desirable for reasons of high throughput. However, a high withdrawal speed for the ingot produces inherently a thin skin or shell at the point of withdrawal from the mold; the danger of rupture rises, therefore, with casting speed. Thus, in reality one operates casting machines at a significantly lower speed than were theoretically possible, simply to ensure a high margin of safety.

DESCRIPTION OF THE INVENTION

It is an object of the present invention to provide a method and equipment which permits continuous control and supervision of the current condition of the ingot in a continuous casting machine so as to permit higher casting speeds without increasing the risk of rupture.

In accordance with the preferred embodiment of the present invention, it is suggested to measure the total heat flow into the mold at least in a partial circumferential range thereof, and to measure also the ratio of the heat flows in upper and lower portions of that range. The measuring values are used to establish and to define a current operating point which is superimposed upon a range of reference value to determine whether or not the operating point is within that range. Preferably, a two dimensional plotting technique is used, if visual representation is desired. In addition or in the alternative, signal representation of the reference range may be provided for an electrical signal comparison and for automatic reduction of the casting and steel feed speeds when the operating point exceeds the range. In the case of using mere visual representation, closed loop operation may involve manual intervention of an operator.

The several heats are indirectly measured by measuring cooling water temperature and by forming electrically signals representing temperature differentials between different portions of the cooling path and flow. For measuring the total heat flow, it may be necessary to measure also the flow rate of the cooling water itself unless that rate is or is kept constant.

The invention is based on the recognition and discovery that in the case other parameters such as casting speed, level in the mold etc. remain constant, the formation of the skin is primarily determined by the total heat flow into the mold (which is the same or proportional to the heat being removed from the mold by cooling). This parameter is the primary determinant of skin thickness. Additionally, the skin formation is determined by the heat flow distribution in the mold, which can be represented (at least in the first order) by the ratio of the heats flowing into upper and lower halves of the mold. This ratio is the primary determining factor of the surface temperature of the casting skin in and in the vicinity of the mold.

These two parameters together indicate the temperature gradient in the skin. As stated above, they are used to define and establish a current or running operating point. In a two dimensional representation each operating point is associated with particular ranges of skin thickness and temperature gradient in the skin. Different melts each are associated with a particular range or set of operating points in that plane of two dimensional representation. Safe subranges can readily be determined empirically and are to be used as the reference for operating points during true runs to maintain safe operating conditions and to avoid rupture by temporarily at least reducing the rate of metal flow into the mold and the withdrawal speed of the ingot from the mold. Establishing the reference range may be carried out empirically by using the same or similar equipment which is to be used subsequently for true supervision and/or control and by measuring additionally, for example, skin thickness and surface temperature of an emerging ingot to thereby set the metes and bounds, which determine the safe range for high speed operation.

Aside from automatic or manual reduction of the withdrawal and feed speeds when the safe range is exceeded, one may increase the amount and rate of flow of spray water directed against the casting directly underneath the mold exit. Withdrawal reduction and spray water increase may both be used in cases. It should be observed here that either or both steps are usually needed only temporarily whereafter operation can return to normal conditions as the causes for the escape of the operating point from the safe range are usually temporary in nature.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE is block diagram, partially a schematic cross-section through equipment for practicing the present invention.

Proceeding now to the detailed description of the drawing, the figure shows a portion of a liquid cooled mold 5 for continuous casting. The dash dot line may represent the center line of the mold. The mold has a gap or ducts 6 for passage of cooling liquid, e.g. water from an entrance 7 to an exit 4.

The gap or duct system 6 may include the entire cooling duct system for the mold, so that 4 and 5 represent exit and entrance for the entire coolant flow. However, the mold walls may be sectionalized circumferentially as far as coolant flow is concerned, whereby the cooling flow path in such a section still covers the entire vertical length of the mold at least to the extent its inner surface is in contact with molten, solidifying steel. In the case of circumferential sectionalization 4 and 5 will be exit and entrance for cooling water of the particular section only.

The casting or ingot consists of a liquidous core 14 in a shell 13, which grows in thickness in the direction of casting. Reference numeral 15 refers to the first one of a plurality of rolls for withdrawing and guiding the cast ingot. Others are provided downstream of the ingot as withdrawn and at least some of these are driven by a controllable drive 25 which may be speed-controlled for varying the ingot withdrawal speed. Secondary, external cooling is provided along the withdrawn ingot, particularly directly underneath the bottom of the mold. Device 26 and others spray such water.

The water temperature is measured at or near the entrance 7 to the cooling duct system 6 by means of a temperature sensor 1 (e.g. a thermocouple or any other suitable thermo-transducer). Analogously, the water temperature at or near the exit 4 is measured by a similar temperature sensor 3. A third temperature sensor 2 is disposed in about the middle of the water path within gap or duct 6.

Each of the sensors provides an electrical signal which is a running indication of the water temperature in the location of the respective sensor. Accordingly, these signals represent water temperatures $T_1$, $T_2$, and $T_3$. A first electrical circuit network 8 is connected to sensors 1 and 2 and forms or calculates the temperature difference $T_1-T_2$. A second network 9 is connected to sensors 2 and 3 and forms a signal representing the temperature difference $T_2-T_3$. Thus, the output of network 8 represents the increase in water temperature in the lower half of the mold. These temperature increases represent respectively the heat inflow from the interior of the mold, through the mold wall and into the heat removing water flow.

The two networks 8 and 9 have their respective outputs connected to two inputs of another calculating network 10 forming a signal that is or represents the quotient of the measuring values as represented by the output signals of networks 8 and 9. This quotient will be termed K and represents indirectly surface temperature of the forming skin.

Still another network 11 is connected to the sensors 1 and 2 and forms a difference signal representing the difference between exit and entrance temperatures of the cooling water. This difference signal represents the total heat transfer Q from the molten metal into the mold, through the initial skin and into the mold wall (or a section thereof) from which that heat is removed by the cooling water. This representation is a direct one only if the rate of flow of the water through duct 6 remains constant. Otherwise a correction is needed in that the amount of water is separately ascertained by flow meter 17, and a multiplication network 16 multiplies the signal representing the water quantity per unit time entering the duct 6 at entrance 5, and the output signal from network 11 with each other. The network 16 is not needed, if, for example, the rate of flow of the cooling water is or is held constant.

The networks 8, 9, 10, 11, and 16 may be algebraic, analog signal processing circuits known per se for forming difference, quotient and product signals. Alternatively, they may be portions of a digital calculating facility with analog inputs as I/O equipment. Conventional mini-computers are readily usable here.

The two outputs respectively of networks 10 and 11 are fed to a device 12, which may include an indicator, such as two component plottet, a cathode ray tube or the like. In either case, the outputs of networks 10 and 11 serve as coordinate values in a real or a hypothetical two dimensional representation or manifestation. The ratio value K and the total heat flow Q (per unit time and, possibly, per section) together define a current operating point for the casting process which must stay within a particular range. That range may be separately represented (e.g. pre-plotted) on the indicating portion of device 12, if provided. Operating personnel must observe whether or not the operating point as indicated is or remains within the range. That critical range may have been predetermined experimentally and empirically and under utilization of the same equipment as well as additional equipment to determine truly safe ranges for operating points for high speed casting.

Any deviation from the predetermined range is an indication that safe operation may not continue at the given rate and casting speed and can be used to instigate personnel to lower the casting speed (withdrawal rate) and to lower also the amount of molten steel fed into the mold 5.

Alternatively, the device 12 may include calculating capabilities for comparing the electrical signals representing K and Q with stored reference values representing the range of safe operation. If that range is exceeded, i.e. if the current operating point escapes from that range, device 12 can be used to provide control signals to lower the withdrawal speed as well as the rate of feeding steel into the mold. Additionally, optical and/or accoustical warning and alarm signals may issue. The representation of the operating point as coordinated in a mini-computer may still be regarded as equivalent or manifestation of a two dimensional representation of the current operating point. The reference range of safe operation is analogously defined by stored coordinate data (indirect two dimensional representation). Device 12 may be a part of the same mini-computer which includes devices 8, 9, 10, 11, and 16 and which issues signals or command for the withdrawal drive and the steel feeding device. Visual indication on a CRT-device can readily be provided for as operation running parallel to any automatic control. As stated above, the rate of spray cooling the ingot externally, particularly right at the bottom of the mold, may be increased to ensure more rapid skin growth, counteracting any tendency to rupture.

The invention has the advantage that the casting machine can be operated normally close to the limit of its capabilities. The casting conditions and particularly the formation of the casting and ingot is under continuous supervision, so that conditions which may lead to skin rupture can be recognized early and such rupture can be prevented by reducing the casting speed and by increasing cooling. The equipment is, therefore, more productive than was heretofore possible, because normally one can operate at casting speeds, which previously had to be avoided for reasons of safety.

The invention is not limited to the embodiments described above, but all changes and modifications thereof not constituting departures from the spirit and scope of the invention are intended to be included.

We claim:

1. Method for supvervising the continuous casting of steel, comprising the steps of:

detecting the amount of heat flowing into at least a circumferentially partial section of the casting mold and providing a measuring value representative thereof;

detecting as separate quantities the heat flows, respectively, into the mold in upper and lower portions of that section and providing measuring values representative thereof;

computing the ratio of the measuring values representing the heat flows into the upper and lower portions;

forming an operating point from the measuring value in accordance with the first detecting step and said ratio and referencing the operating point to a predetermined range.

2. Method as in claim 1, wherein said values are plotted in two dimensions for forming said operating point.

3. Method as in claim 1 and including the step of reducing the withdrawal speed of the casting as well as the rate of feeding steel into the mold when said operating point escapes from said range.

4. Method as in claim 1 and including the step of increasing spray water cooling of the casting directly underneath the mold when the said operating point escapes from said range.

5. Apparatus for supervising continuous casting of steel by means of a mold having walls which have a path through which flows a coolant, comprising:

first means for detecting the amount of heat flowing into at least a partial circumferential section of the casting mold and providing a measuring value representative thereof;

second means for detecting separately the heat flows into the mold in upper and lower portions of that section and providing, respectively, measuring values representative thereof;

third means for computing the ratio of the measuring values as detected by the second means;

means for forming a manifestation of an operating point from the measuring value as provided by first means and the ratio as computed by the third means; and means for referencing the operating point or its manifestation to a predetermined range.

6. Apparatus as in claim 5, wherein the two detecting means include three thermosensors placed respectively for measuring entrance and exit temperatures of the coolant as flowing through said path, and for measuring the coolant temperature in about the middle of the mold along the coolant path, the first detecting means including the sensors for measuring entrance and exit temperatures and including means for forming a signal representing the difference of the latter temperatures, the second detecting means including the three thermosensors and means for forming the differences between middle and entrance temperatures, and exit and middle temperatures.

7. Apparatus as in claim 6 and including means for detecting the rate of flow of the coolant and providing a signal representative thereof and means for multiplying the signal representing the waterflow with the signal as provided by the first detecting means.

8. Apparatus as in claim 5, wherein the means for forming and referencing include a two-dimensional visual plotter or the like.

9. Method for controlling the continuous casting of steel, comprising the steps of:

detecting the amount of heat flowing into at least a circumferentially partial section of the casting mold and providing a measuring value representative thereof;

detecting as separate quantities the heat flows, respectively, into the mold in upper and lower portions of that section and providing measuring values representative thereof;

computing the ratio of the measuring values representing the heat flows into the upper and lower portions;

forming an operating point from the measuring value in accordance with the first detecting step and said ratio; and controlling the casting process in dependence upon the operating point.

10. Method as in claim 9, wherein the controlling step includes the step of reducing the withdrawal speed of the casting as well as the rate of feeding steel into the mold when said operating point escapes from said range.

11. Method as in claim 9, wherein the controlling step includes the step of increasing spray water cooling of the casting directly underneath the mold when the said operating point escapes from said range.

* * * * *